US009698512B2

(12) United States Patent
Saller et al.

(10) Patent No.: US 9,698,512 B2
(45) Date of Patent: Jul. 4, 2017

(54) ELECTRICAL CONTACT HAVING CLEANING SYSTEM

(71) Applicant: Lisa Draexlmaier GmbH, Vilsbiburg (DE)

(72) Inventors: Robert Saller, Egglkofen (DE); Xiayuan Zhang, Ingolstadt (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 0 days.

(21) Appl. No.: 15/192,003

(22) Filed: Jun. 24, 2016

(65) Prior Publication Data

US 2016/0380375 A1 Dec. 29, 2016

(30) Foreign Application Priority Data

Jun. 25, 2015 (DE) ..... 10 2015 110 226

(51) Int. Cl.

| | |
|---|---|
| ***H01R 13/52*** | (2006.01) |
| ***H01R 13/11*** | (2006.01) |
| ***H01R 13/193*** | (2006.01) |
| ***H01R 13/46*** | (2006.01) |

(52) U.S. Cl.

CPC ..... *H01R 13/113* (2013.01); *H01R 13/11* (2013.01); *H01R 13/193* (2013.01); *H01R 13/46* (2013.01)

(58) Field of Classification Search

CPC H01R 13/113; H01R 13/5205; H01R 13/193; H01R 31/102; H01R 13/11; H01R 13/46

See application file for complete search history.

(56) References Cited

U.S. PATENT DOCUMENTS

| | | | | | |
|---|---|---|---|---|---|
| 2,735,998 | A * | 2/1956 | Martines | H01R 13/115 | 439/849 |
| 2,742,628 | A * | 4/1956 | Batcheller | H01R 13/115 | 439/849 |
| 2,770,792 | A * | 11/1956 | Batcheller | H01R 13/115 | 439/849 |
| 5,588,884 | A * | 12/1996 | Rudoy | H01R 31/02 | 439/787 |

(Continued)

FOREIGN PATENT DOCUMENTS

| | | |
|---|---|---|
| DE | 948428 C | 8/1956 |
| DE | 42 20 716 A1 | 1/1994 |

(Continued)

*Primary Examiner* — Jean F Duverne

(74) *Attorney, Agent, or Firm* — Finnegan, Henderson, Farabow, Garrett & Dunner LLP

(57) ABSTRACT

Embodiments disclose an electrical contact including a metal housing and a fixed contact part, which is attached to the metal housing and has a contact surface that, during the attachment, is located within the metal housing, and a contact tab located outside the metal housing. The electrical contact includes a movable contact part, which can be inserted into the metal housing to form an electrical contact together with the contact surface of the fixed contact part. A cleaning system is provided in that at least one scraping edge is provided adjoining the contact surface, the movable contact part making contact with said scraping edge during insertion. A surface of the movable contact part passes over the scraping edge to remove possible dirt particles.

22 Claims, 7 Drawing Sheets

(56) References Cited

U.S. PATENT DOCUMENTS

| | | | | |
|---|---|---|---|---|
| 7,241,189 | B2 * | 7/2007 | Mohs | H01R 13/113 439/845 |
| 8,998,656 | B2 * | 4/2015 | Amano | H01R 13/113 439/845 |
| 2003/0109181 | A1 * | 6/2003 | Bungo | H01R 13/193 439/852 |
| 2003/0194919 | A1 * | 10/2003 | Hsieh | H01R 13/5205 439/845 |
| 2014/0308857 | A1 | 10/2014 | Goesmann et al. | |

FOREIGN PATENT DOCUMENTS

| | | | |
|---|---|---|---|
| DE | 10 2010 011 547 | A1 | 9/2011 |
| DE | 10 2013 007 166 | A1 | 10/2014 |
| DE | 10 2013 106 117 | A1 | 12/2014 |
| DE | 10 2014 115 745 | A1 | 5/2015 |
| DE | 10 2015 104 377 | A1 | 9/2016 |
| EP | 0 262 487 | A1 | 4/1986 |
| EP | 2 752 945 | A2 | 7/2014 |
| JP | 2010-267584 | A | 11/2010 |
| WO | WO 2007/012883 | A1 | 2/2007 |

* cited by examiner

ELECTRICAL CONTACT HAVING CLEANING SYSTEM

CROSS REFERENCE TO RELATED APPLICATION

This application is based upon and claims the benefit of prior German Patent Application No. 10 2015 110 226.9, filed on Jun. 25, 2015, the entire contents of which are incorporated herein by reference.

TECHNICAL FIELD

The present disclosure relates to an electrical contact having a fixed and a movable contact part in a metal housing, for which a cleaning system is being introduced.

BACKGROUND

DE 10 2015 104 377 discloses an electrical contact in which a fixed and a movable contact part can be connected to each other via a large contact surface. The two contact parts are disposed within a metal housing and pressed against each other by way of a leaf spring. It is furthermore disclosed how the two contact parts can be locked with respect to each other by way of a metal pin. However, the contact includes a variety of drawbacks. For example, dirt particles, which are introduced via the contact surfaces of the contact parts or develop during operation of the contact, compromise the contact quality over time.

DE 4 220 716 A1 and DE 10 2014 115 745 A1 disclose sealing lips, which may also have a cleaning effect. However, while these lips keep a cable insulation or insertion socket clean, they do not clean the contact surface.

SUMMARY

Embodiments of the present disclosure provide a cleaning system for an electrical contact.

The electrical contact according to the present disclosure contains a metal housing and a fixed contact part, which is attached to the metal housing and has a contact surface, which during the attachment is located within the metal housing, and a contact tab located outside the metal housing. The electrical contact furthermore contains a movable contact part, which can be inserted into the metal housing and thus forms an electrical contact together with the contact surface of the fixed contact part. The cleaning system is introduced in that a surface of the fixed or movable contact part which establishes the electrical contact forms a profile having low-profile and high-profile portions. Scraping edges are disposed between the low-profile and high-profile portions. The scraping edges are angled less than 90° with respect to an insertion direction of the movable contact part and define a profile formed of rhombi.

In embodiments of the present disclosure, during the first insertion of the movable contact part, dirt particles stemming from the production of the contact part or the transport are removed, or at least the number of dirt particles is reduced. In this way, the electrical contact may have a cleaned contact and a lower contact resistance starting with the first use. This may be useful for high-current contacts.

In embodiments of the present disclosure, the rhombic shape in the profile does not significantly increase a required insertion force for the movable contact part and facilitates the removal of the dirt particles.

In embodiments of the present disclosure, a second dirt reservoir, which can accommodate a large number of dirt particles, is formed between the low-profile and high-profile portions of the surface. The second dirt reservoir can have a width of 0.2 to 1 mm, and preferably approximately 0.5 mm, and a depth of 0.3 to 1.2 mm, and preferably approximately 0.8 mm, for this purpose. This profile may simplify the manufacturing process and may accommodate any accumulating larger dirt particles without impairing the contact surface.

In embodiments of the present disclosure, the ratio of the required insertion force to the removal of dirt particles is optimal at an angle of 15 to 45°, and in particular at an angle of 30 to 40°, of the scraping edges relative to the insertion direction.

According to an embodiment of the present disclosure, the profile includes a plurality of rhombi, wherein the rhombi have a larger length than width in the insertion direction. This may also ensure that a large number of scraping edges is available for cleaning.

In embodiments of the present disclosure, the second dirt reservoir is formed by multiple gaps, which divide the profile in a rectilinear manner and have sharp edges with respect to the contact surface. As a result of the sharp-edged design, it is possible to easily separate oxide particles and surface impurities.

In embodiments of the present disclosure, the profile is disposed on the contact surface of the fixed contact part. When installed, the fixed contact part is typically disposed beneath the movable contact part, so that the dirt particles cannot fall out of the dirt reservoir and onto the contact surface.

In embodiments of the present disclosure, chamfers on narrow sides and deburred edges on broad sides may be provided as insertion aids within the profile. The production may be cost-effective when the profile is created by way of embossing and stamping. If the low-profile portions of the profile have a smaller surface than the high-profile portions, the use of the cleaning system reduces the contact surface only marginally.

In embodiments of the present disclosure, a further cleaning system is introduced in that at least one further scraping edge is provided near the contact surface, the movable contact part making contact with this scraping edge during insertion. A surface of the movable contact part which later establishes the contact thus passes over the scraping edge and possible dirt particles are removed.

According to an embodiment of the present disclosure, a dirt reservoir is provided adjoining the scraping edge. During a relative movement between the fixed and movable contact parts, the aforementioned dirt particles fall into the dirt reservoir. This may ensure that the dirt particles do not contaminate the contact surface again after scraping.

According to an embodiment of the present disclosure, a cleaning lip made of a plastic material is attached as the scraping edge. The cleaning lip is attached to an opening of a connector housing surrounding the metal housing. The cleaning lip thus makes contact with a surface of the movable contact part every time the movable contact part is inserted into the metal or connector housing and scrapes off the dirt particle. The dirt particles are then already scraped off the first time they could find their way into the connector housing.

According to an embodiment of the present disclosure, the cleaning lip is made of a softer material compared to the connector housing. For example, if the connector housing is made of a thermoplastic, then the material of the cleaning lip is either a soft thermoplastic or a hard elastomer. Furthermore, the upper face of the cleaning lip may be chamfered, for example downwardly sloping into the interior of the connector housing. Due to this relatively sharp edge, it is possible, using little friction, to scrape off the majority of the dirt particles and not allow them to penetrate into the housing in the first place. Should dirt particles still find their way into the interior of the connector housing via the cleaning lip, they will slide via the downwardly sloping surface into a first dirt reservoir, which may be disposed between the end face of the fixed contact part and the connector housing. This is thus located beneath the movable contact part and next to the contact surface and will no longer reach the contact surface. The cleaning lip may be disposed perpendicularly to the insertion direction.

According to an embodiment of the present disclosure, the cleaning lip has an opening that does not impair the scraping edge, but makes the metal housing accessible from outside the connector housing, even in the installed state. This may be advantageous when the metal housing must be unlocked from the connector housing by way of pliers or a screwdriver.

According to an embodiment of the present disclosure, the metal housing has a latching device on the upper and lower faces, which is used for securing within the connector housing. The metal housing is thus non-slidably disposed in the connector housing, even though forces act on the metal housing as a result of the insertion of the movable contact part in the insertion direction.

According to an embodiment of the present disclosure, the metal housing is box-shaped and has cut-outs on the lateral walls used to attach the fixed contact part near the lower face of the metal housing. Ultimately, the fixed contact part is fixed in the metal housing in these cut-outs, wherein the fixed contact part comprises catch lugs on the side regions thereof for this purpose.

According to an embodiment of the present disclosure, so as to generate a pressing force between the contact parts, the metal housing contains a leaf spring in the interior. During insertion of the movable contact part, the leaf spring is slightly tensioned. The pressing force and locking may include an additional locking mechanism, for example, as described in DE 10 1015 104 377. The metal housing comprises a convex region toward the housing interior for this purpose so as to establish the starting and end positions of a movable locking pin. In the end position, the locking pin locks the leaf spring in a pressure position with respect to the contact parts.

According to an embodiment of the present disclosure, the material can be selected separately for each of the design components. The contact parts are made of copper, for example, and may optionally be coated with silver to further decrease the contact resistance. Independently of the selection of the electrical contact elements, the metal housing may be made of steel to ensure sufficient mechanical strength.

The described properties of the present disclosure and the manner in which these are achieved will be described in more detail based on the following detailed description. The foregoing general description and the following detailed description are exemplary and explanatory only, and are not restrictive of embodiments consistent with the present disclosure. Further, the accompanying drawings illustrate embodiments of the present disclosure, and together with the description, serve to explain principles of the present disclosure.

DETAILED DESCRIPTION

Figure 1:
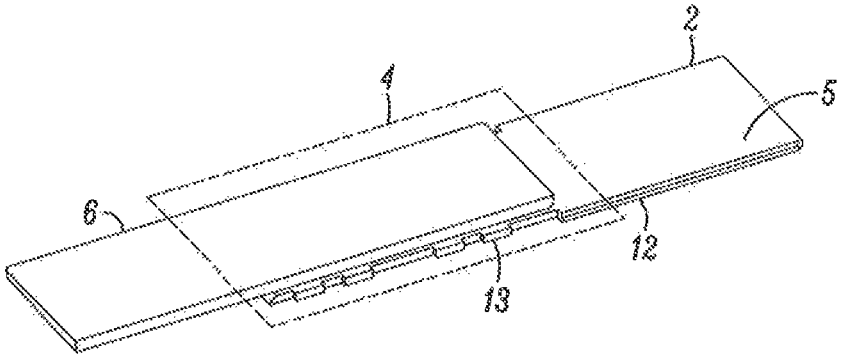
FIG. 1 shows an exemplary contact region between a fixed and a movable contact part.

FIG. 1 shows how the fixed contact part 2 cooperates with the movable contact part 6 to establish an electrical contact. The two contact parts 2, 6 are flat stampings, wherein the fixed contact part 2 comprises catch lugs 13 at the side regions 12 thereof, in this example four on each of the two sides. The overlapping region of the two contact parts 2, 6 is formed by the contact surface 4. The remaining region of the fixed contact part 2 forms a contact tab 5, which can be connected to electrical lines or other contact parts corresponding to the respective contacting modules for a weld connection, screw connection or clinch connection.

In view of the relatively large contact surface 4, dirt particles between the contact parts 2, 6 would adversely affect the contact quality. The dirt particles would also be very difficult to remove from the contact surface during operation.

Figure 2:
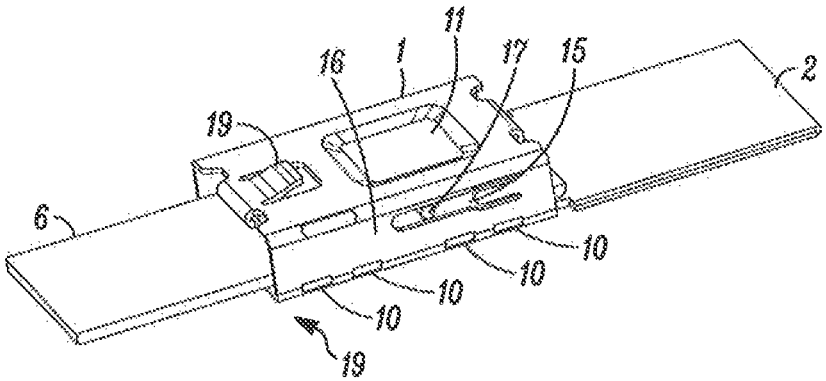
FIG. 2 shows an exemplary high-current contact comprising a metal housing.

FIG. 2 shows how the high-current contact establishes a rigid connection between the movable and fixed contact parts 2, 6 by way of a metal housing 1. The metal housing 1 is box-shaped and on the side surfaces thereof has cut-outs 10 (four on each of the two sides), which correspond to the catch lugs 13 of the fixed contact part 2. In this way, the fixed contact part 2 is secured near a bottom surface of the metal housing 1. This may be achieved, for example, in that the metal housing 1 is initially bent open slightly, so that the fixed contact part 2 can be inserted, and the metal housing 1 is then bent into the final box shape thereof and compressed.

The metal housing 1 comprises two latching devices 19, on the top and bottom faces of the metal housing 1. The metal housing 1 additionally includes a concave portion 11, which protrudes into the housing interior. A locking pin 17, which can be displaced along the axis of the high-current contact, is visible in a further elongated hole-shaped opening in the side walls of the metal housing 1. The pin may reach a starting position 15 and an end position 16. The locking pin assumes the starting position 15 when the movable contact part is being inserted. Once the movable contact part 6 has been completely inserted, the locking pin 17 is moved into the end position 16 and pushes the leaf spring (which is not visible here and shown in FIGS. 9A-C) more strongly against the movable contact part 6, and moreover locks the two contact parts 2, 6 with respect to each other. In addition to the end points of the elongated hole-shaped opening, the bevels of the concave portion 11 are used to set the two positions 15, 16 for the locking pin 17.

Figure 3:
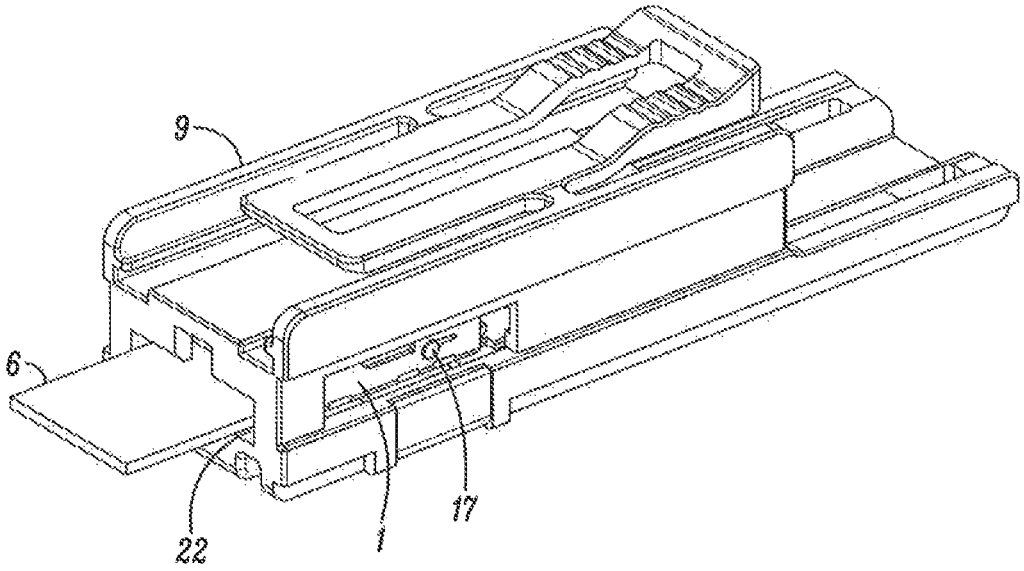
FIG. 3 shows an exemplary high-current contact comprising a surrounding connector housing made of plastic material.

FIG. 3 shows how the metal housing 1 is disposed within a connector housing 9 made of a thermoplastic resin. With the exception of the locking pin 17, the remaining elements of the metal housing 1 are not illustrated and described again here. The connector housing has an opening 22 into which the movable contact part 6 can be inserted. The opening 22 is slot-shaped to accommodate the movable contact part 6 and moreover has an indentation through which the latching devices 19 shown in FIG. 2 are accessible by way of pliers or a screwdriver.

Figure 4:
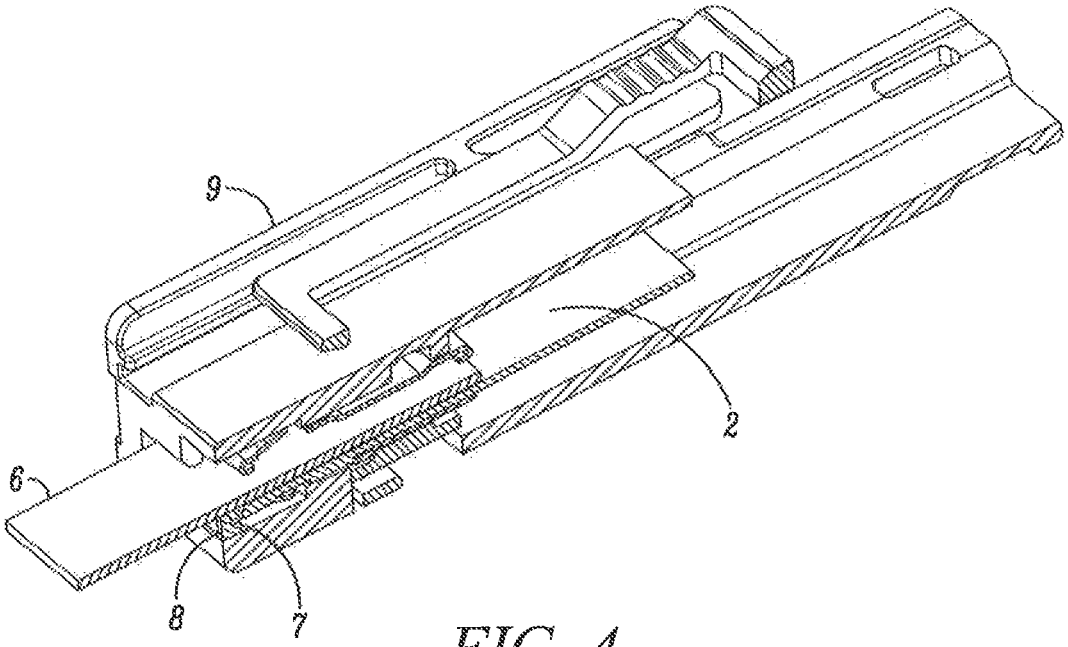
FIG. 4 shows a sectional illustration of the high-current contact shown in FIG. 3.

FIG. 4 illustrates how the movable contact part 6 penetrates into the connector housing 9 and the metal housing 1 and ultimately reaches the fixed contact part 2. A scraping edge 8, which is designed as a cleaning lip, is disposed near the opening 22 of the connector housing 9. Directly adjoining the cleaning lip 8 is a first dirt reservoir 7, which is located between the connector housing 9 and the end face of the fixed contact part 2. Scraped-off dirt particles fall into the dirt reservoir 7. The cleaning lip 8 is softer than the connector housing 9 and is made of a soft thermoplastic material or a hard elastomer and has a beveled edge on the upper face thereof. In this exemplary embodiment, the beveled edge is downwardly sloping into the housing interior, so that the majority of the dirt remains outside the connector housing 9 during scraping.

Figure 5:
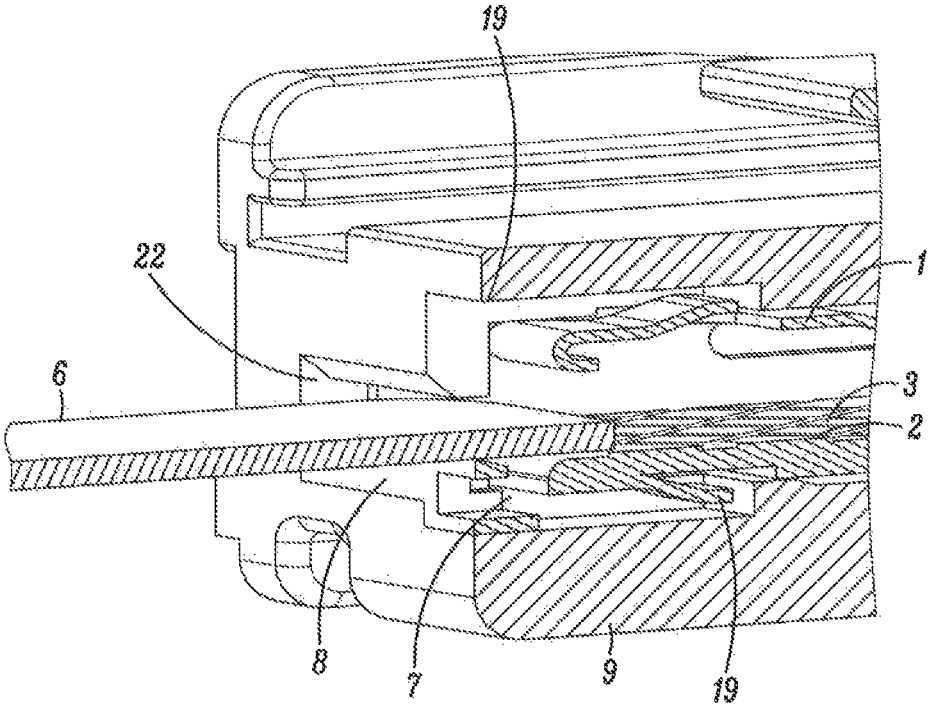
FIG. 5 shows a section of the high-current contact in the region of an opening of the connector housing.
Figure 6:
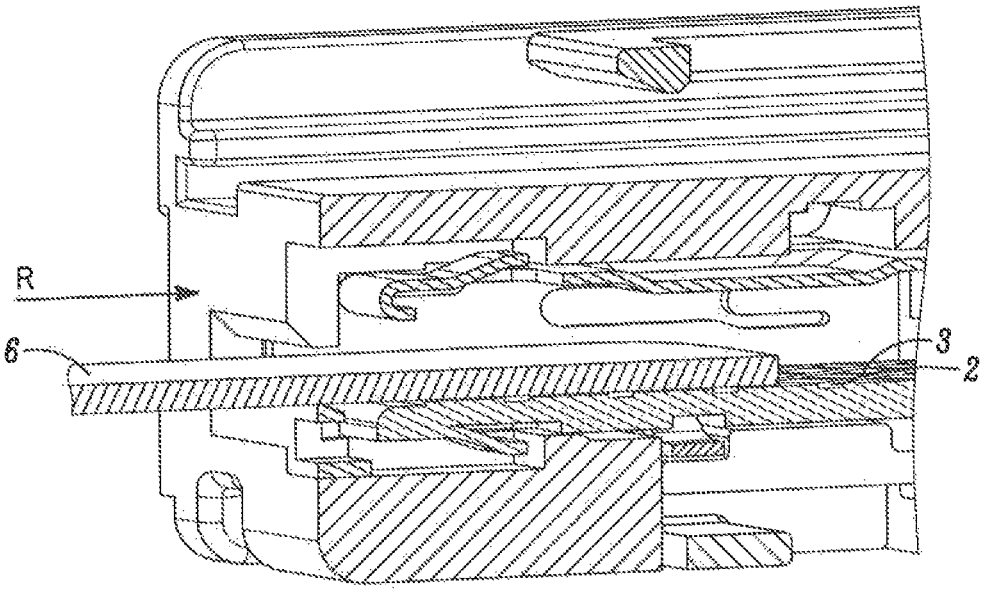
FIG. 6 shows the high-current contact shown in FIG. 5, however with a movable contact part that is inserted further.

FIGS. 5 and 6 show the process of inserting the movable contact part 6. FIG. 5 shows the moment at which the movable contact part 6 makes contact with the cleaning lip 8, when the movable contact part 6 passes through the opening 22 of the connector housing 9. FIG. 5 illustrates how the latching devices 19 on the upper and lower faces of the metal housing 1 latchingly engage with the connector housing 9. In addition, the dirt reservoir 7 is also visible. The profile 3, which will be described in more detail hereafter, comprises further scraping edges and is also indicated on the fixed contact part 2.

In FIG. 6, the movable contact part 6 has been moved further in the insertion direction R and is now in contact with the fixed contact part 2. At this moment, the movable contact part 6 also passes over the profile 3 and makes contact with the scraping edges located there.

Figure 7:
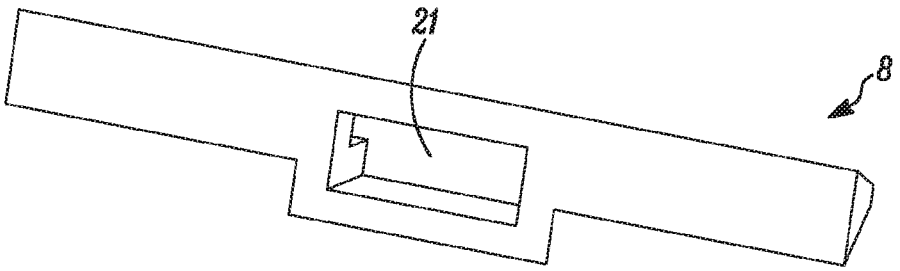
FIGS. 7 and 8 show illustrations of an exemplary cleaning lip.
Figure 8:
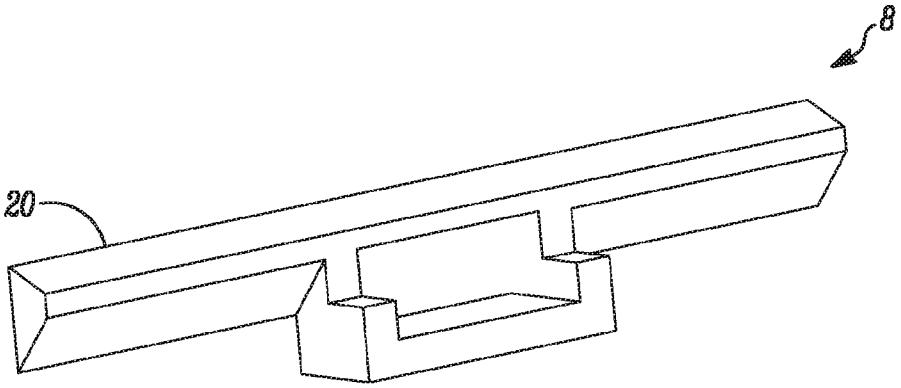

FIGS. 7 and 8 show cleaning lips 8 from a variety of viewing directions. The scraping edge, which, as described above, is chamfered and downwardly sloping into the housing interior, is located on the upper face 20 of the cleaning lip 8. Beneath the scraping edge, an opening 21 is provided in the cleaning lip 8, which, as is apparent from FIG. 5, is used to access the latching device 19 on the lower face of the metal housing 1 with the aid of pliers or a screwdriver for releasing the latched connection between the metal housing 1 and the connector housing 9. The two latching devices 19 can be accessed through the opening 21 and through the opening 22 in the connector housing above the movable contact part 6. The cleaning lip 8 thus does not block the access to this latching device 19.

The cleaning lip 8 and the connector housing 9 may be produced as a two-component injection-molded part. Alternatively, the cleaning lip 8 may also be glued or clamped into the connector housing 9.

Figure 9A:
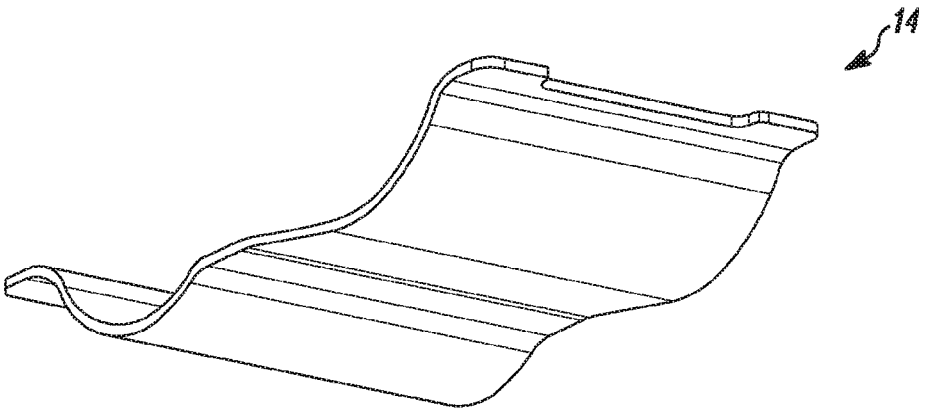
FIG. 9A shows an exemplary leaf spring.
Figure 9B:
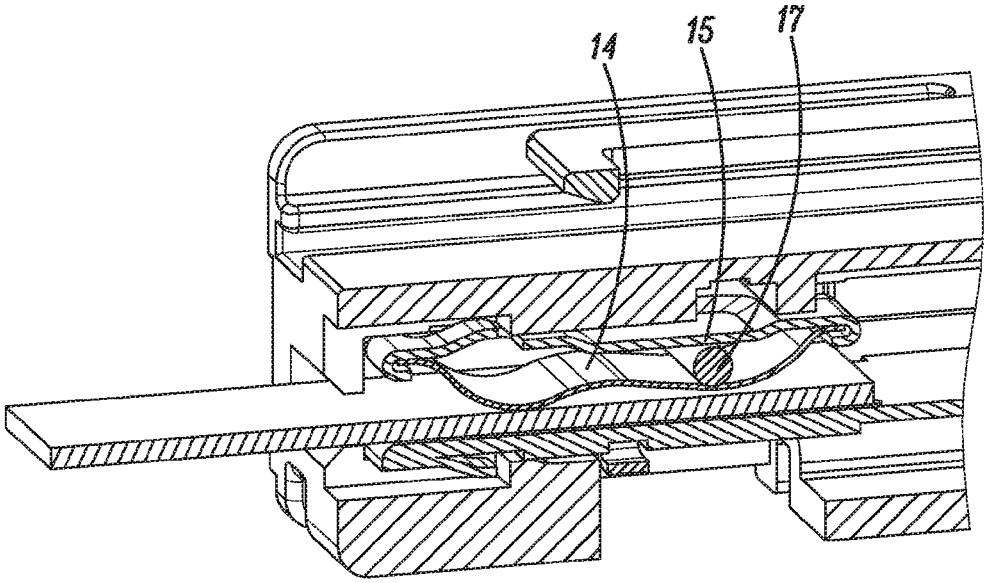
FIG. 9B shows a starting position of the locking pin.
Figure 9C:
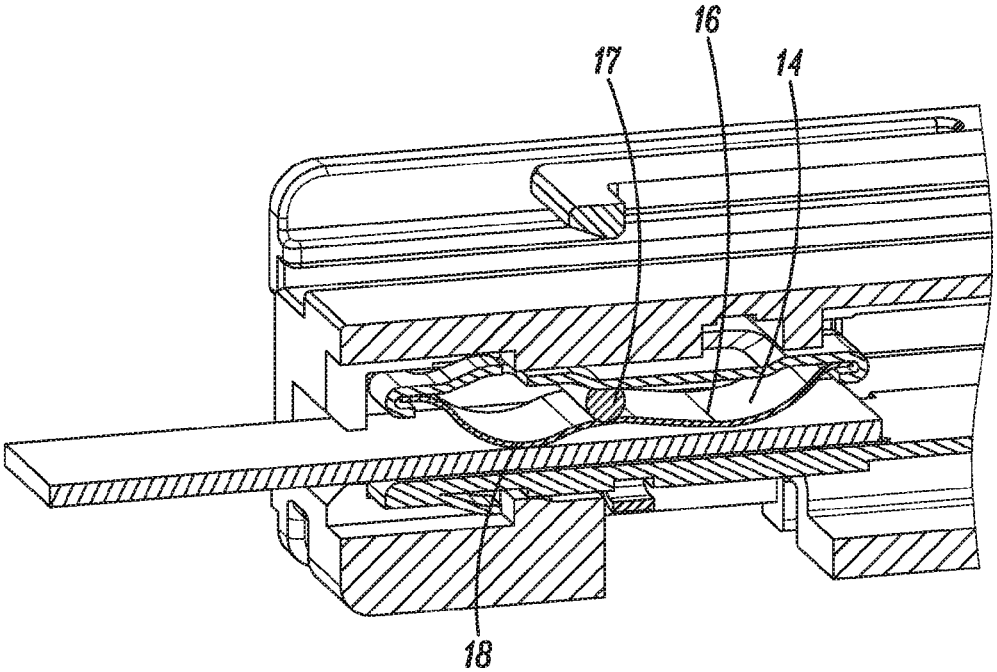
FIG. 9C shows an end position of the locking pin.

FIG. 9A shows a leaf spring 14, which is clamped into position by corresponding hooks in the metal housing. The leaf spring 14 made of steel has a hump shape, as a result of which the locking pin 17 (which is not shown in FIG. 9A) in a starting position 15 (see FIG. 9B) applies little pressure on the leaf spring 14, but in an end position 15 (see FIG. 9C) the leaf spring 14 curves more strongly and is pushed against the movable contact part, thereby creating a pressure position 18. The operating principle of the leaf spring 14 is described in greater detail in DE 10 2015 104 377.

Figure 10:
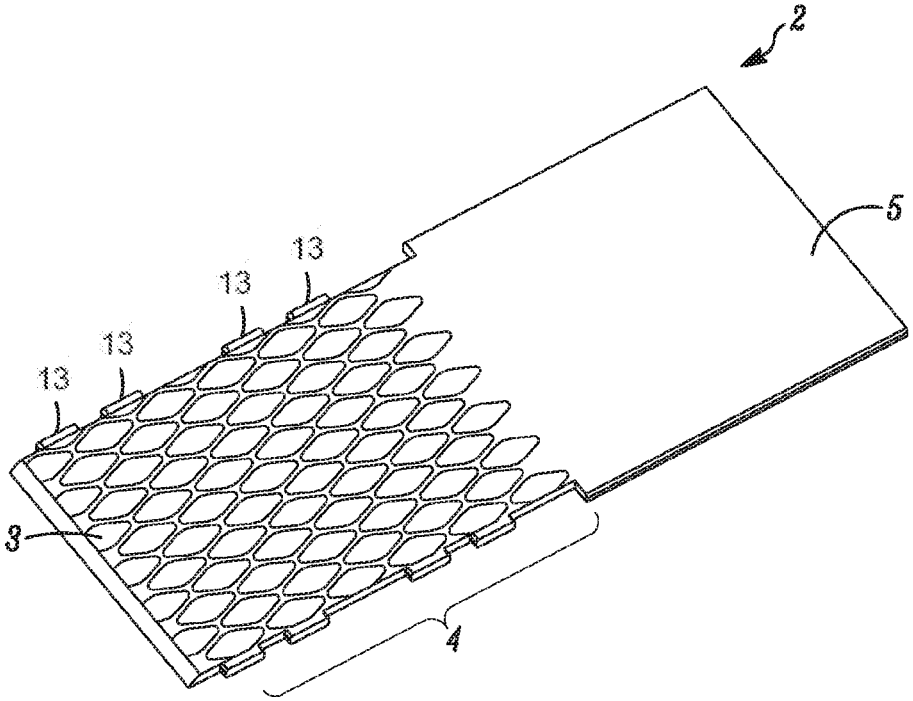
FIG. 10 shows an exemplary movable contact part having a profile.

The fixed contact part 2 according to FIG. 10 is composed of two parts, these being a contact tab 5 and a profile part that forms the contact surface 4 against the movable contact part (not shown). The catch lugs 13 on the side surfaces of the fixed contact part 2 are also visible here, as is a shoulder between the contact tab 5 and the remainder of the fixed contact part 2, which implements a stop on the metal housing (not shown).

Figure 11:
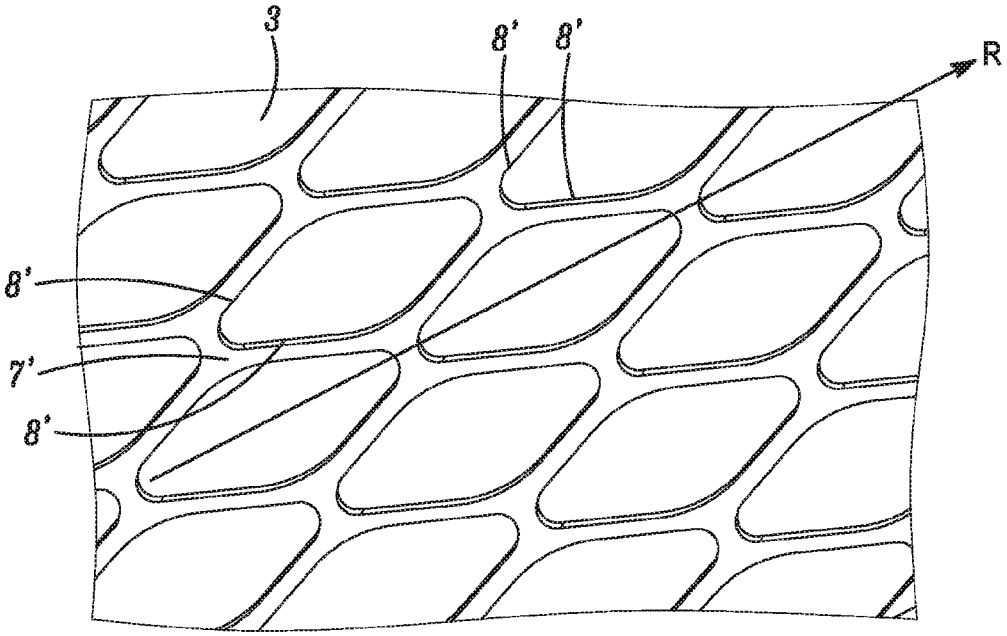
FIG. 11 shows a close-up illustration of the profile within the contact surface of the fixed contact part.

The profile 3 generated by way of embossing and stamping on the surface of the fixed contact part 2 has a rhombic shape, comprising a plurality of scraping edges 8' identified by way of example in FIG. 11, which form an acute angle in relation to the insertion direction R. In this way, dirt particles are cleaned from the surface of the movable contact part by making contact multiple times with the scraping edges 8'.

These dirt particles fall into dirt reservoirs 7' formed between the scraping edges 8'. The dirt reservoirs 7' are thus located between the low-profile and high-profile portions of the profile 3. FIG. 11 also shows that the overall surface area of the low-profile portions is lower than the share of the high-profile portions. The ratio of the low-profile portions to the high-profile portions is approximately 1:5 to 1:10.

Figure 12:
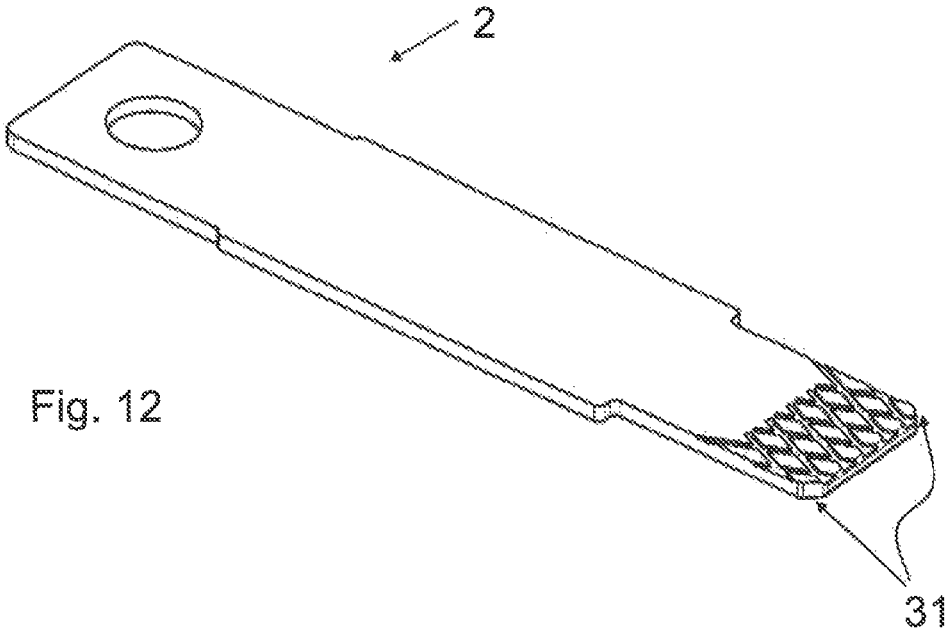
FIGS. 12 and 13 show further exemplary variants of the profile having a rhombic shape.
Figure 13:
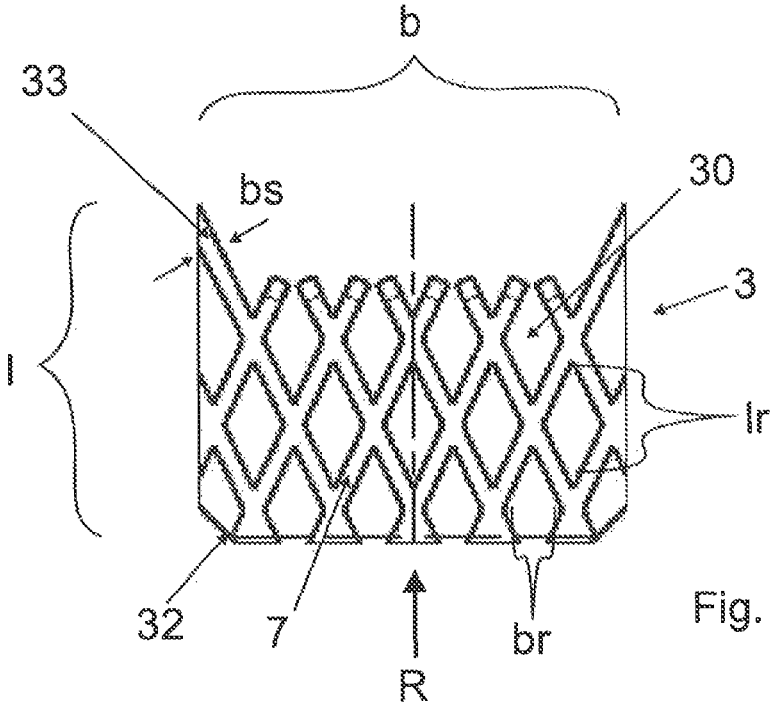

The dimensions of the profile 3 are more clearly apparent from FIGS. 12 and 13. The profile 3 according to FIG. 12 is located at only one end of the fixed contact part 2, and may be located at the end that first makes contact with the movable contact part 6. Since the fixed contact part 2 also has to be inserted into the above-described metal housing 1, chamfers 31 are provided on the sides of this end, which serve as an insertion aid.

According to FIG. 13, the profile 3 extends across a length l of 7.5 mm and across the entire width b of the movable contact part 2, which is 12 mm. This is intended to illustrate how important it is to cover the entire width of the contact part 2 with the profile 3, but only a smaller portion of the length of the contact part 2 must be configured with the profile 3. The profile 3 directly adjoins the end of the fixed contact part 2. Rhombi 30 form the high-profile portions of the profile 3. The rhombi 30 have a length lr of 3.5 mm and a width br of 1.7 mm. As a result, a larger number of rhombi 30, and thus also many scraping edges 8', can be disposed on the relative small surface area of the profile 3. The scraping edges 8' have a sharp-edged design.

Gaps 33, which form the low-profile portions of the profile 3, and thus also the dirt reservoir 7', are disposed between the rhombi 30. The gaps 33 are disposed at an angle of 35° relative to the insertion direction R. The gaps 33 are rectilinear to ensure good dirt particle transport and have a width bs of 0.5 mm and a depth of 0.8 mm.

While the present disclosure is illustrated and described in detail according to the above embodiments, the present disclosure is not limited to these embodiments and additional embodiments may be implemented. Further, other embodiments and various modifications will be apparent to those skilled in the art from consideration of the specification and practice of one or more embodiments disclosed herein, without departing from the scope of the present disclosure.

| List of reference numerals | |
|---|---|
| Metal housing | 1 |
| Fixed contact part | 2 |
| Profile of the fixed contact part | 3 |
| Contact surface | 4 |
| Contact tab | 5 |
| Movable contact part | 6 |
| Dirt reservoir | 7, 7' |
| Scraping edge | 8, 8' |
| Connector housing | 9 |
| Cut-outs | 10 |
| Concave portion | 11 |
| Side regions of the fixed contact part | 12 |
| Catch lugs | 13 |
| Leaf spring | 14 |
| Starting and end positions of the locking pin | 15, 16 |
| Locking pin | 17 |
| Pressure position of leaf spring | 18 |
| Latching device | 19 |
| Upper face of the cleaning lip | 20 |
| Opening in the cleaning lip | 21 |
| Opening of the connector housing | 22 |
| Rhombus | 30 |
| Chamfers | 31 |
| Deburred edge | 32 |
| Gap | 33 |
| Insertion direction | R |
| Length of the profile | l |
| Width of the profile | b |
| Length of the rhombus | lr |
| Width of the rhombus | br |
| Width of the gap | bs |

What is claimed is:

1. An electrical contact, comprising:

a metal housing;

a fixed contact part attached to the metal housing, the fixed contact part having a contact surface located within the metal housing and a contact tab located outside the metal housing; and a movable contact part configured to be inserted into the metal housing to form an electrical contact with the contact surface of the fixed contact part;

wherein a surface of at least one of the fixed contact part or the movable contact part establishing the electrical contact forms a profile having low-profile portions, high-profile portions, and scraping edges formed between the low-profile and high-profile portions, and wherein the scraping edges are angled less than 90° with respect to an insertion direction of the movable contact part into the metal housing, the scraping edges defining a plurality of rhombi.

2. The electrical contact according to claim 1, wherein the scraping edges form an angle of 15 to 45° with respect to an insertion direction of the movable contact part into the metal housing.

3. The electrical contact according to claim 1, wherein the plurality of rhombi have a larger length than width with respect to the insertion direction of the movable contact part into the metal housing.

4. The electrical contact according to claim 1, wherein the profile is disposed on the contact surface of the fixed contact part.

5. The electrical contact according to claim 4, wherein the fixed contact part further includes chamfers on narrow sides of the profile and debarred edges on broad sides of the profile.

6. The electrical contact according to claim 1, wherein the profile is generated by embossing and stamping the contact part, and the love-profile portions of the profile have a smaller surface area than the high-profile portions.

7. The electrical contact according to claim 1, further comprising: a cleaning lip located near the contact surface, the cleaning lip being configured to make contact with the movable contact part during insertion.

8. The electrical contact according to claim 7, further comprising:

a dirt reservoir adjoining the cleaning lip, the dirt reservoir being configured to collect dirt particles during a relative movement between the fixed contact part and the movable contact part.

9. The electrical contact according to claim 7, further comprising:

a connector housing enclosing the metal housing, the connecting housing having an opening for receiving the movable contact part, and wherein the cleaning lip is attached to the opening and configured to scrape off dirt particles when making contact with the surface of the movable contact part.

10. The electrical contact according to claim 9, wherein the cleaning lip is made of a softer material than the connector housing, and the cleaning lip has a chamfered upper face downwardly sloping into the interior of the connector housing.

11. The electrical contact according to claim 7, wherein the cleaning lip includes an opening for accessing the metal housing.

12. The electrical contact according to claim 9, further comprising:

a dirt reservoir disposed between the end face of the fixed contact part and the connector housing, the dirt reservoir being configured to collect the scraped dirt particles.

13. The electrical contact according to claim 1, further comprising:

a connector housing enclosing the metal housing;

a first latching device on an upper face of the metal housing; and a second latching device on a lower face of the metal housing;

wherein the first and second latching devices are configured to secure the metal housing within the connector housing.

14. The electrical contact according to claim 1, wherein the metal housing is box-shaped and lateral walls of the metal housing have cut-outs formed therein for attaching the fixed contact part to a lower face of the metal housing.

15. The electrical contact according to claim 1, further comprising:

a leaf spring disposed in an interior of the metal housing, the leaf spring being configured to generate a pressing force between the contact parts.

16. The electrical contact according to claim 15, further comprising:

a movable locking pin;

wherein:

the metal housing has a concave portion protruding into the housing interior for establishing a starting position and an end position of the movable locking pin, and the end position is configured to lock the leaf spring in a pressured position to secure the contact parts to each other.

17. The electrical contact according to claim 1, wherein the fixed contact part is a flat stamping having catch lugs on side regions, the side regions being configured to secure the fixed contact part to the metal housing.

18. The electrical contact according to claim 1, wherein:

the contact parts are made of copper;

the surfaces of the contact parts are coated with silver; and the metal housing is made of steel.

19. The electrical contact according to claim 1, wherein a second dirt reservoir is formed between the low-profile and high-profile portions.

20. The electrical contact according to claim 19, wherein the second dirt reservoir has a width of 0.2 to 1 mm.

21. The electrical contact according to either claim 19, wherein the second dirt reservoir has a depth of 0.3 to 1.2 mm.

22. The electrical contact according to claim 19, wherein the second dirt reservoir is formed by multiple gaps dividing the profile in a rectilinear manner, and the second dirt reservoir has sharp edges with respect to the contact surface.

* * * * *